US012553446B2

(12) United States Patent
Chen

(10) Patent No.: US 12,553,446 B2
(45) Date of Patent: Feb. 17, 2026

(54) HANGING NECK FAN

(71) Applicant: Shenzhen Aikuli Technology Co., Ltd, Shenzhen Guangdong (CN)

(72) Inventor: Miaosheng Chen, Shenzhen Guangdong (CN)

( * ) Notice: Subject to any disclaimer, the term of this patent is extended or adjusted under 35 U.S.C. 154(b) by 26 days.

(21) Appl. No.: 18/423,417

(22) Filed: Jan. 26, 2024

(65) Prior Publication Data

US 2025/0223975 A1 Jul. 10, 2025

(30) Foreign Application Priority Data

Jan. 5, 2024 (CN) ..... 202420027965.9

(51) Int. Cl.

| | |
|---|---|
| ***F04D 25/08*** | (2006.01) |
| ***F04D 25/06*** | (2006.01) |
| ***F04D 29/32*** | (2006.01) |
| ***F04D 29/52*** | (2006.01) |

(52) U.S. Cl.

CPC ..... *F04D 25/08* (2013.01); *F04D 25/0673* (2013.01); *F04D 29/325* (2013.01); *F04D 29/522* (2013.01)

(58) Field of Classification Search

None

See application file for complete search history.

(56) References Cited

U.S. PATENT DOCUMENTS

2024/0392794 A1* 11/2024 Chen ..... F04D 25/068

FOREIGN PATENT DOCUMENTS

| | | | |
|---|---|---|---|
| CN | 212615503 B1 | | 2/2021 |
| CN | 212615503 U | * | 2/2021 |
| CN | 217129887 B1 | | 8/2022 |

OTHER PUBLICATIONS

Lai et al—CN 217129887 U + machine translation (Year: 2022).*
CN212615503U—MachineTranslation (Year: 2021).*

* cited by examiner

*Primary Examiner* — Juan G Flores

(57) ABSTRACT

A hanging neck fan is disclosed, including a main board, a battery, a first fan wheel and a second fan wheel. The battery is electrically connected to the main board, and the first fan wheel and the second fan wheel are electrically connected to the main board respectively. The hanging neck fan further includes a first housing and a second housing, the first housing and/or the second housing are configured with the first fan wheel and the second fan wheel inside. The first fan wheel and the second fan wheel are disposed back-to-back, the first fan wheel is configured to blow air toward a free end of the first housing. Thus the hanging neck fan can effectively improve wearing comfort, and an axial flow fan is used, making such product less expensive and more efficient in blowing air.

6 Claims, 9 Drawing Sheets

HANGING NECK FAN

TECHNICAL FIELD

The present application relates to the technical field of portable fans, and in particular to a hanging neck fan.

BACKGROUND

In many outdoor scenarios, both hands are usually required, for example, pushing a stroller, soaking baby milk powder, riding a bicycle, carrying items, holding mobile devices, outdoor work, etc., thus both hands cannot be released. In addition, it is easy to sweat in summer heat, and cooling demands cannot be met by handheld fans, so there appear hanging neck fans in market to achieve cooling regulation.

At present, most of hanging neck fans in the market is designed by providing a centrifugal fan at a front end of a fan clamping arm, see Patent No. CN 201922492811.9, which discloses a hanging neck fan. However, a weight of the hanging neck fan is relatively tilted forward, and in a case that dynamic balance of such fan is not good enough, wind is guided out from both ends of the fan clamping arm, which brings more obvious vibration feelings and causes more noise, making wearing comfort of a user poor, while the centrifugal fan price is relatively high, resulting in an overall cost of a finished product of the hanging neck fan is high. Therefore, an urgent problem that needs to be solved for an ordinary skill in the art is how to provide a novelty hanging neck fan with comfortable wearing and less costly.

SUMMARY

In view of these, the present disclosure aims to provide a novelty hanging neck fan, which can effectively improve wearing comfort, and an axial flow fan is used, making such product less expensive and more efficient in blowing air.

In some embodiments of the present disclosure, a hanging neck fan is providing, which includes a main board, a battery, a first fan wheel and a second fan wheel. Herein the battery is electrically connected to the main board and the first fan wheel and the second fan wheel are electrically connected to the main board respectively. In addition, the hanging neck fan further includes a first housing and a second housing, the first housing and/or the second housing are configured with the first fan wheel and the second fan wheel inside. The first fan wheel and the second fan wheel are disposed back-to-back, the first fan wheel is configured to blow air toward a free end of the first housing and also a flow direction of air blown from the first fan wheel is along an axis of the first fan wheel. The second fan wheel is configured to blow air toward a free end of the second housing and also a flow direction of air blown from the second fan wheel is along an axis of the second fan wheel.

In some preferred embodiments of the present disclosure, the hanging neck fan further includes a flexible connector, and the flexible connector is disposed between the first housing and the second housing and connected to the first housing and the second housing, the first fan wheel and the second fan wheel is configured at both ends of the flexible connector.

In some preferred embodiments of the present disclosure, the both ends of the flexible connector are configured with a first "L"-shaped mating surface and a second "L"-shaped mating surface, one end of the first housing that connected to the flexible connector is configured with a third "L"-shaped mating surface, and one end of the second housing that connected to the flexible connector is configured with a fourth "L"-shaped mating surface. Herein the first "L"-shaped mating surface is configured to be fitted with the third "L"-shaped mating surface for connection, and the second "L"-shaped mating surface is configured to be fitted with the fourth "L"-shaped mating surface for connection.

In some preferred embodiments of the present disclosure, the first "L"-shaped mating surface and the second "L"-shaped mating surface are disposed axially symmetrically with respect to a center axis of the flexible connector in a forward projection plane of the hanging neck fan.

In some preferred embodiments of the present disclosure, the both ends of the flexible connector are configured with a first fan wheel bracket and a second fan wheel bracket respectively, and the first fan wheel bracket and the second fan wheel bracket are embedded with the both ends of the flexible connector respectively. The first fan wheel is disposed on the first fan wheel bracket, and the second fan wheel is disposed on the second fan wheel bracket.

In some preferred embodiments of the present disclosure, a part body of the first fan wheel bracket is configured to be protruded from a longitudinal plane of the first "L"-shaped mating surface, and a part body of the second fan wheel bracket is configured to be protruded from a longitudinal plane of the second "L"-shaped mating surface. An end of the first housing where located the third "L"-shaped mating surface is configured to form a first storage space, and an end of the second housing where located the fourth "L"-shaped mating surface is configured to form a second storage space. A portion body of the first fan wheel bracket that protruded from the longitudinal plane of the first "L"-shaped mating surface is configured to be housed in the first storage space when the first "L"-shaped mating surface is fitted with the third "L"-shaped mating surface for connection. A portion body of the second fan wheel bracket that protruded from the longitudinal plane of the second "L"-shaped mating surface is configured to be housed in the second storage space when the second "L"-shaped mating surface is fitted with the fourth "L"-shaped mating surface for connection.

In some preferred embodiments of the present disclosure, the flexible connector is formed a shell shape with "U" curvature in a middle portion where protruding from a forward projection direction of the hanging neck fan, and the shell shape with "U" curvature is configured with an air inlet on a housing surface thereon.

In some preferred embodiments of the present disclosure, the first housing is configured with a first air duct along a direction of the free end thereon, and/or the second housing is configured with a second air duct along a direction of the free end thereon. Further, the first housing is configured with a first air outlet along a direction of the first air duct, and the second housing is configured with a second air outlet along a direction of the second air duct. The first air outlet and the second air outlet are configured in a direction toward a user's head.

In some preferred embodiments of the present disclosure, a plane where located the first fan wheel is paralleled to a plane where located the second fan wheel.

In some preferred embodiments of the present disclosure, the plane where located the first fan wheel is configured to be intersected with the plane where located the second fan wheel to form a first angle, and the first angle is an angle greater than 0° and less than 360°.

Compared with existing technologies, the present disclosure has at least following beneficial effects and advantages. By providing the first housing and the second housing, and also disposing the first fan wheel and the second fan wheel back-to-back within the first housing and/or the second housing, so that the first fan wheel blows toward the free end of the first housing and the second fan wheel blows toward the free end of the second housing, which can allow an overall weight of the fan wheels to be relatively centralized in a neck position, thus creating a better support and improving wearing comfort. In addition, with use of axial fan can make such product less expensive and more efficient in blowing air.

DETAILED DESCRIPTION OF THE EMBODIMENTS

In order to facilitate a better understanding of objectives, structures, features, and efficacy of the present disclosure, the hanging neck fan of the present disclosure will be further described in conjunction with accompanying drawings and specific embodiments below.

Figure 1:
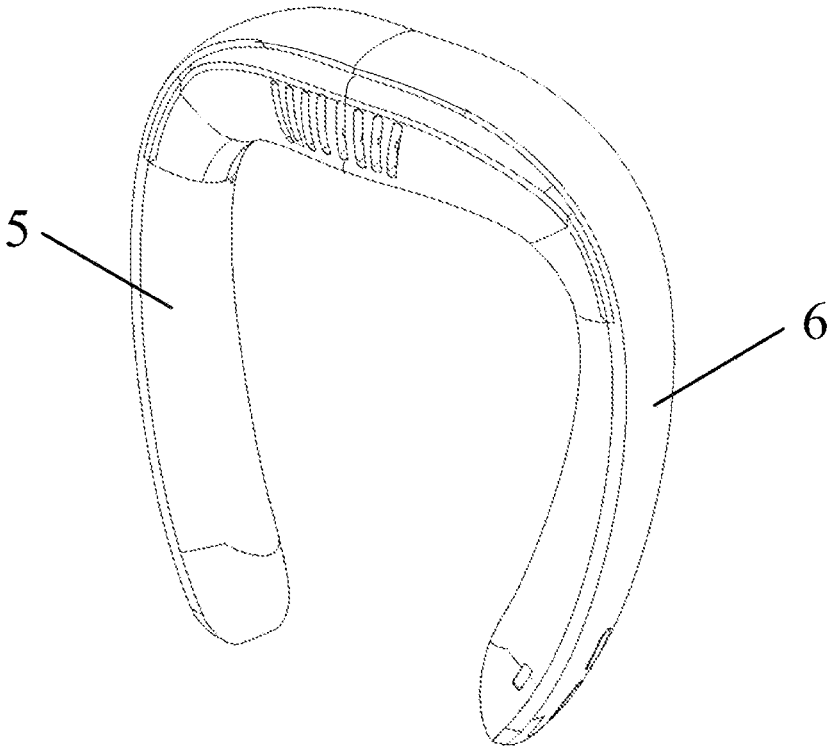
FIG. 1 is a structural schematic diagram of a hanging neck fan in accordance with some embodiments of the present disclosure.
Figure 2:
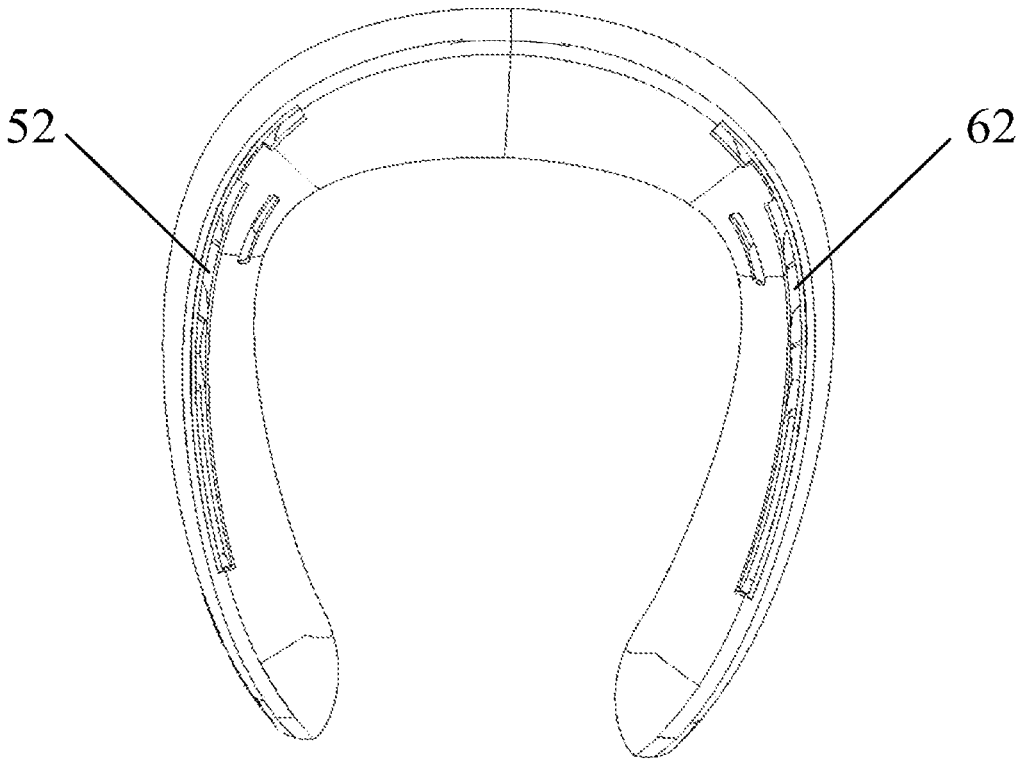
FIG. 2 is a structural schematic diagram of another view of the hanging neck fan of FIG. 1.

Referring to FIG. 1 and FIG. 2, in some embodiments of the present disclosure, a hanging neck fan is provided, and the hanging neck pan includes a main board 1, a battery 2, a first fan wheel 3 and a second fan wheel 4. Herein the battery 2 is electrically connected to the main board 1, the first fan wheel 3 and the second fan wheel 4 are electrically connected to the main board 1 respectively. In addition, the hanging neck fan further includes a first housing 5 and a second housing 6, the first housing 5 and/or the second housing 6 are/is configured with the first fan wheel 3 and the second fan wheel 4 inside. The first fan wheel 3 and the second fan wheel 4 are disposed back-to-back, the first fan wheel 3 is configured to blow air toward a free end of the first housing 5 and also a flow direction of air blown from the first fan wheel 3 is along an axis of the first fan wheel 3. The second fan wheel 4 is configured to blow air toward a free end of the second housing 6 and also a flow direction of air blown from the second fan wheel 4 is along an axis of the second fan wheel 4.

In some embodiments of the present disclosure, the first fan wheel 3 and the second fan wheel may be provided in the first housing 5 at the same time, or the first fan wheel 3 and the second fan wheel 4 may be provided in the second housing 6 at the same time, or the first fan wheel 3 and the second fan wheel 4 may be provided in the first housing 5 and the second housing 6 respectively, the first fan wheel 3 and the second fan wheel 4 are provided back-to-back. When two fan wheels are disposed back-to-back, a plane where located the first fan wheel 3 is paralleled to a plane where located the second fan wheel 4, or the plane where located the first fan wheel 3 is configured to be intersected with the plane where located the second fan wheel 4 to form a first angle, and the first angle is an angle greater than 0° and less than 360°. In some embodiments of the present disclosure, the first fan wheel 3 is configured to blow air toward a free end of the first housing 5 and also a flow direction of air blown from the first fan wheel 3 is along an axis of the first fan wheel 3, the second fan wheel 4 is configured to blow air toward a free end of the second housing 6 and also a flow direction of air blown from the second fan wheel 4 is along an axis of the second fan wheel 4. By such designs, on the one hand, air blown by the fan wheels can be made to blow along an air duct to ends of the free ends, so as to achieve effect of cooling down the neck, and meanwhile, an overall weight of the fan wheels is relatively concentrated in a position of the neck, which can receive better support and effectively improve wearing comfort. On the other hand, with use of an axial fan can make such product less expensive and more efficient in blowing air.

Referring to FIG. 3 to FIG. 9, in some other embodiments of the present disclosure, a hanging neck fan is provided. Herein the hanging neck fan includes a main board 1, a battery 2, a first fan wheel 3 and a second fan wheel 4. Herein the battery 2 is electrically connected to the main board 1, the first fan wheel 3 and the second fan wheel 4 are electrically connected to the main board 1 respectively. In addition, the hanging neck fan further includes a first housing 5, a second housing 6, and a flexible connector 7 connected to one end of the first housing 5 and one end of the second housing 6. Both ends of the flexible connector 7 are configured with the first fan wheel 3 and the second fan wheel 4, and the first fan wheel 3 and the second fan wheel 4 are disposed back-to-back. The first fan wheel 3 is configured to blow air toward a free end of the first housing 5, and the second fan wheel 4 is configured to blow air toward a free end of the second housing 6.

In some other embodiments of the present disclosure, the main board 1 and the battery 2 are provided inside of the hanging neck fan. Specifically, the hanging neck fan includes two main board 1 and two batteries 2. Herein one main board 1 and one battery 2 are provided in the first housing 5, and the other main board 1 and the other battery 2 are provided in the second housing 6. The first housing 5 and the second housing 6 both include a fixed end and a free end, the first housing 5 and the second housing 6 are provided on the both ends of the flexible connector 7 respectively and their fixed ends are connected to the both ends of the flexible connector 7 respectively. In some preferred embodiments of the present disclosure, the first housing 5 and the second housing 6 are disposed axially symmetrically with respect to a center axis of the flexible connector, the first housing 5 and the second housing 6 are formed two clamping arms of the hanging neck fan, and shapes of an inner side of the two clamping arms are fitted with curvature of both sides of a user's neck. Moreover, a shape of an inner side of flexible connector 7 is fitted with curvature of back of a user's neck. When in use, inner sides of the first housing 5 and the second housing 5 are clamped to fit with the both sides of the use's neck, and the inner side of the flexible connector 7 is fitted to the back of the user's neck. As a preferred embodiment of the present disclosure, the first housing 5 and the second housing 6 are made of hard rubber materials, preferably plastic, and the flexible connector 7 is made of soft rubber materials, preferably silicone.

By setting the flexible connector 7 in the middle of the hanging neck fan, so that the flexible connector 7 can connect the fixed end of the first housing 5 and the fixed end of the second housing 6. Meanwhile, by disposing the first fan wheel 3 and the second fan wheel 4 back-to-back in the both ends of the flexible connector 7, which can make an overall weight of the two fan wheels is relatively concentrated in the position of the neck, and can be better supported. At the same time, the two fall wheels are disposed at the both ends of the flexible connector 7 respectively, so that the weight of the two fan wheels is distributed evenly at the both ends of the flexible connector 7, which can effectively avoid resonance with the housings and also can reduce sense of vibration during the user's use, and thereby reducing noise of the hanging neck fan during its use and improving wearing comfort of the hanging neck fan.

Figure 3:
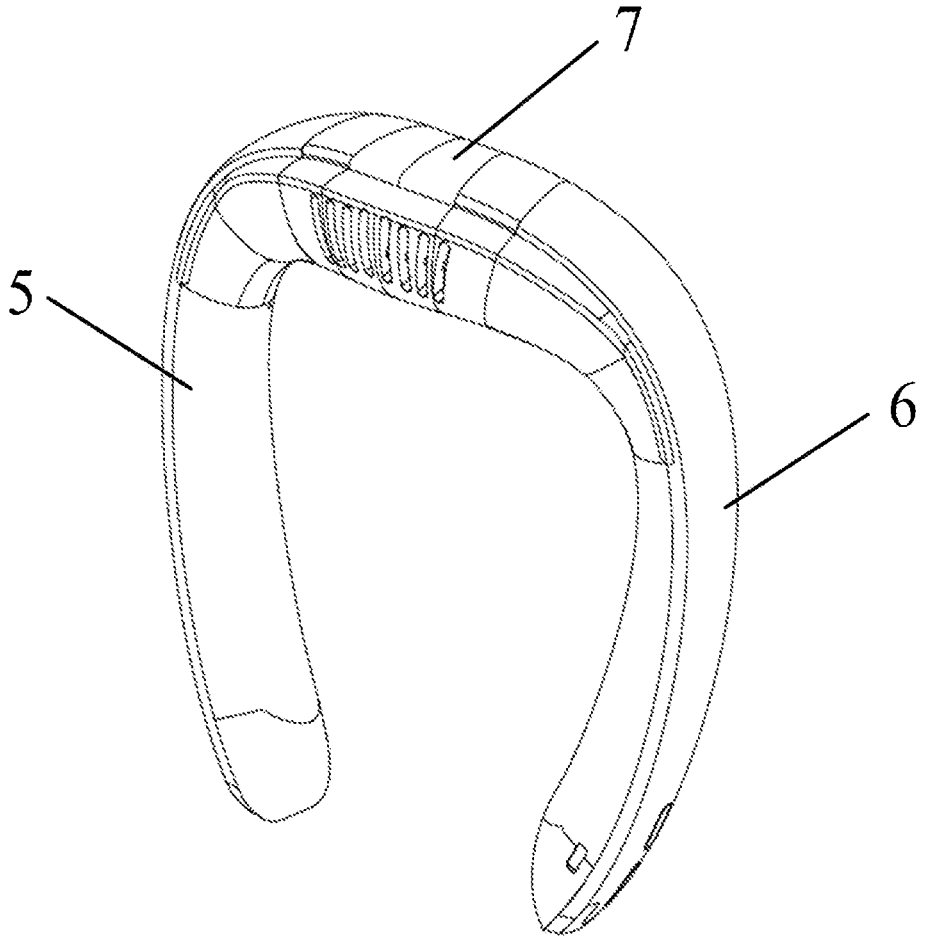
FIG. 3 is a structural schematic diagram of a hanging neck fan in accordance with some other embodiments of the present disclosure.
Figure 4:
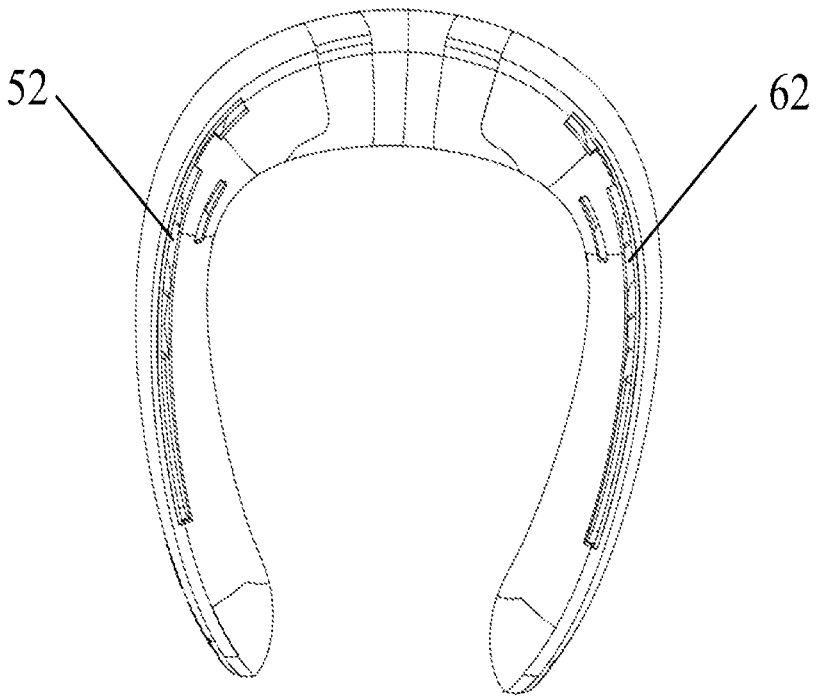
FIG. 4 is a structural schematic diagram of another view of the hanging neck fan of FIG. 3.
Figure 7:
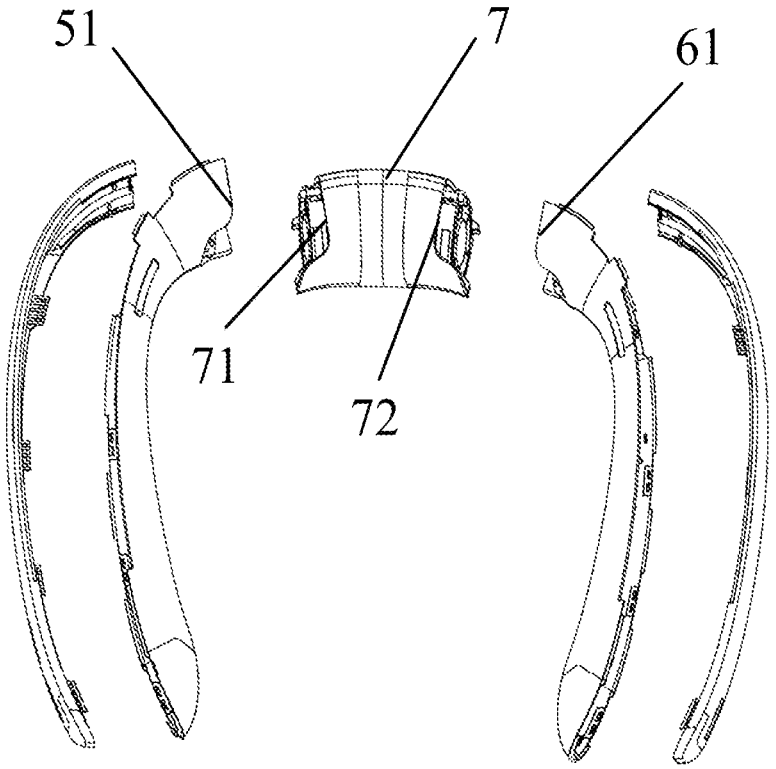
FIG. 7 is another structural exploded view of the hanging neck fan of FIG. 3.
Figure 8:
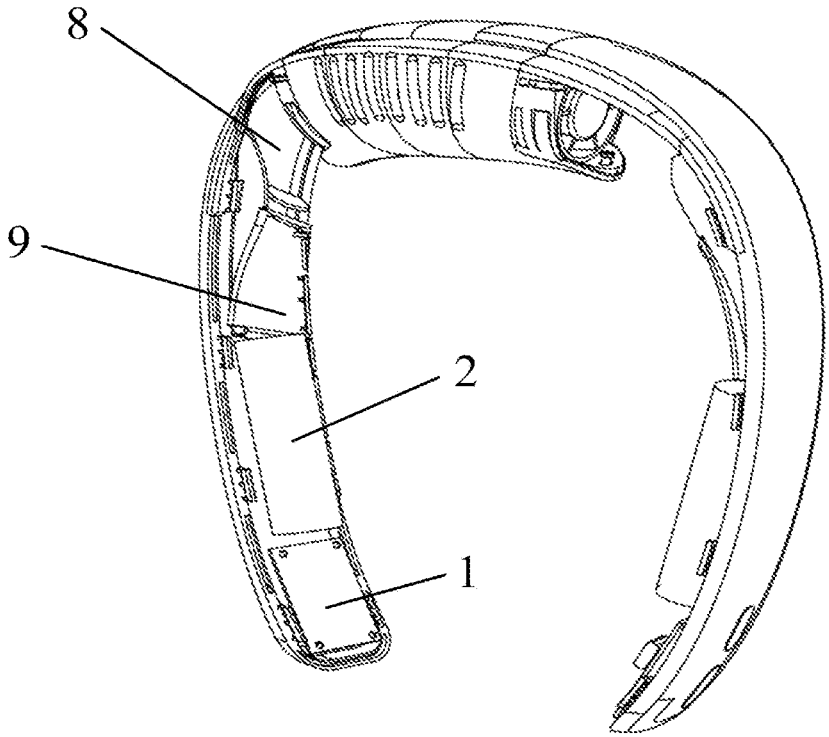
FIG. 8 is a local structural schematic diagram inside of the hanging neck fan of FIG. 3.
Figure 9:
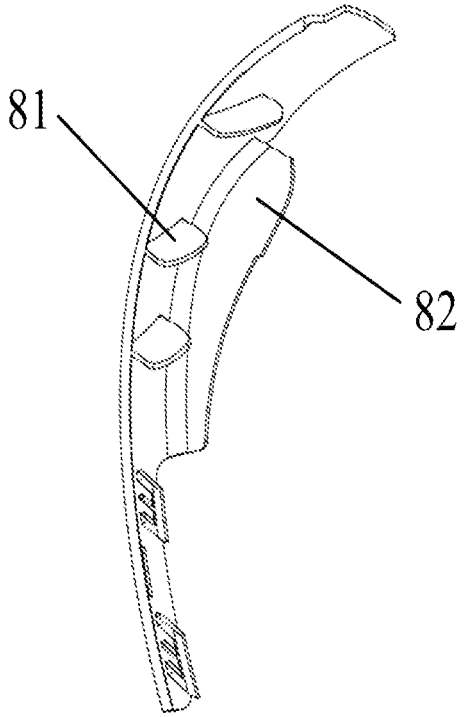
FIG. 9 is a structural schematic diagram of a wind deflector of the hanging neck fan of FIG. 3.

Referring to FIG. 3 and FIG. 7, the both ends of the flexible connector 7 are configured with a first "L"-shaped mating surface 71 and a second "L"-shaped mating surface 72, one end of the first housing 5 that connected to the flexible connector 7 is configured with a third "L"-shaped mating surface 51, and one end of the second housing 6 that connected to the flexible connector 7 is configured with a fourth "L"-shaped mating surface 61. The first "L"-shaped mating surface 71 is configured to fit with the third "L"-shaped mating surface 51 for connection, and the second "L"-shaped mating surface 72 is configured to fit with the fourth "L"-shaped mating surface 61 for connection.

In some embodiments of the present disclosure, the first "L"-shaped mating surface 71 and the second "L"-shaped mating surface 72 are disposed axially symmetrically with respect to a center axis of the flexible connector 7 in a forward projection plane of the hanging neck fan. By setting such symmetrical shape, the hanging neck fan is more convenient for processing and manufacturing, and meanwhile, an appearance of the hanging neck fan can be made to look more beautiful. The "L"-shaped mating surface can effectively limit connecting parts, to avoiding relative movements and loosening of the connecting parts during use. Of course, in some other embodiments of the present disclosure, the mating surfaces may be other shapes, such as "T"-shaped, "K"-shaped, and is not limited to these.

Figure 5:
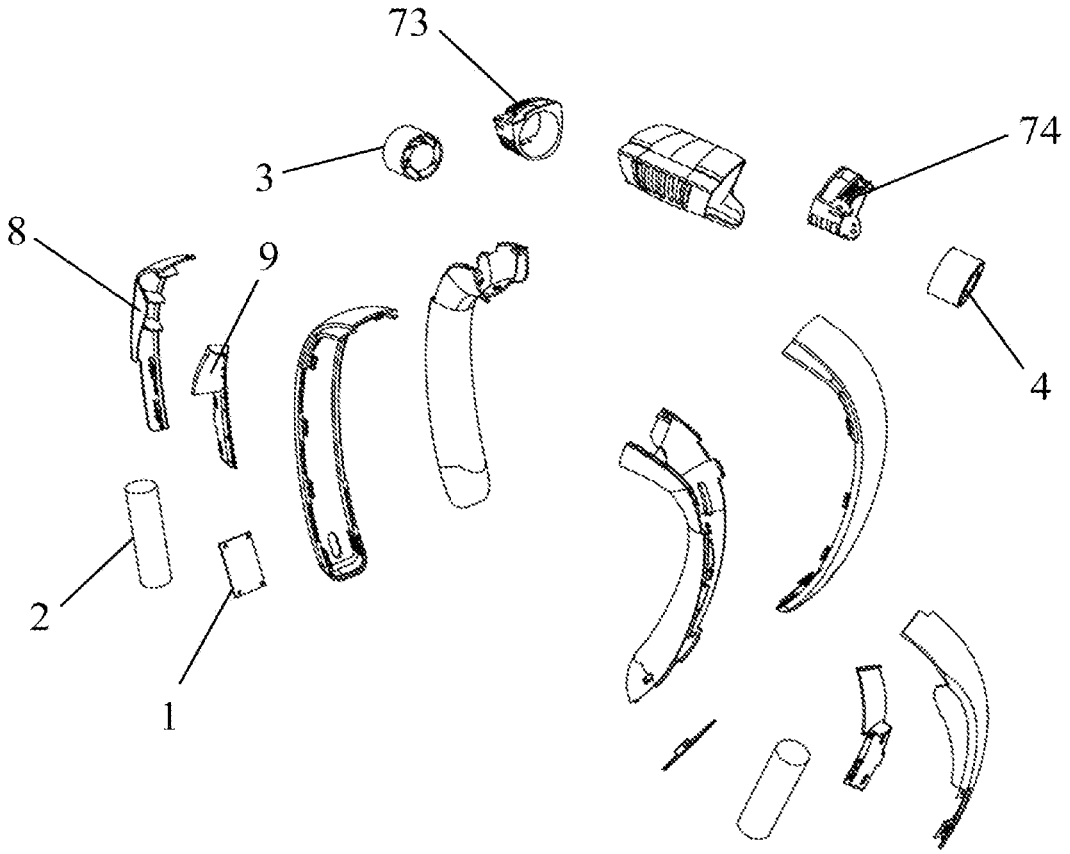
FIG. 5 is a structural exploded view of the hanging neck fan of FIG. 3.
Figure 6:
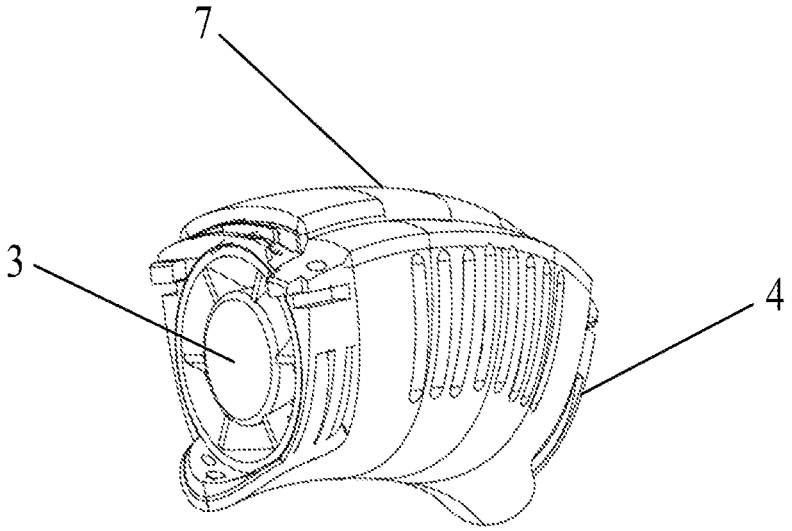
FIG. 6 is a structural schematic diagram of a flexible connector of the hanging neck fan of FIG. 3.

Referring to FIG. 5 and FIG. 6, the both ends of the flexible connector 7 are configured with a first fan wheel bracket 73 and a second fan wheel bracket 74 respectively, and the first fan wheel bracket 73 and the second fan wheel bracket 74 are embedded with the both ends of the flexible connector 7 respectively. The first fan wheel 3 is disposed on the first fan wheel bracket 73, and the second fan wheel 4 is disposed on the second fan wheel bracket 74.

In some embodiments of the present disclosure, the first fan wheel 3 is detachably connected to the first fan wheel bracket 73 and the second fan wheel 4 is detachably connected to the second fan wheel bracket 74. The first fan wheel bracket 73 and the second fan wheel bracket 74 are respectively embedded with the both ends of the flexible connector 7. The flexible connector 7, the first fan wheel bracket 73 and the first fan wheel 3 are designed into modularized structures, which can make such product more flexible and convenient in a process of manufacturing and assembly. As one preferred embodiment of the present disclosure, between the first fan wheel 3 and the first fan wheel bracket 73, between the first fan wheel bracket 73 and the end of the flexible connector 7, is a snap connection. Between the second fan wheel 4 and the second fan wheel bracket 74, between the second fan wheel bracket 74 and the end of the flexible connector 7, is a snap connection. Of course, in other embodiments of the present disclosure, between the first fan wheel 3 and the first fan wheel bracket 73, between the first fan wheel bracket 73 and the end of the flexible connector 7, between the second fan wheel 4 and the second fan wheel bracket 74, between the second fan wheel bracket 74 and the end of the flexible connector 7, may be other forms of connection. For example, a connection that screws to each other, and is not limited to this.

Referring to FIG. 5 and FIG. 7, a part body of the first fan wheel bracket 73 is configured to be protruded from a longitudinal plane of the first "L"-shaped mating surface 71, and a part body of the second fan wheel bracket 74 is configured to be protruded from a longitudinal plane of the second "L"-shaped mating surface 72. An end of the first housing 5 where located the third "L"-shaped mating surface 51 is configured to form a first storage space, and an end of the second housing 6 where located the fourth "L"-shaped mating surface 61 is configured to form a second storage space. A portion body of the first fan wheel bracket 73 that protruded from the longitudinal plane of the first "L"-shaped mating surface 71 is configured to be housed in the first storage space when the first "L"-shaped mating surface 71 is fitted with the third "L"-shaped mating surface 51 for connection. A portion body of the second fan wheel bracket 74 that protruded from the longitudinal plane of the second "L"-shaped mating surface 72 is configured to be housed in the second storage space when the second "L"-shaped mating surface 72 is fitted with the fourth "L"-shaped mating surface 61 for connection.

In some embodiments of the present disclosure, the "L"-shaped mating surfaces include a longitudinal plane and a transverse plane. Herein a part body of the first fan wheel bracket 73 is configured to be protruded from a longitudinal plane of the first "L"-shaped mating surface 71, and a part body of the second fan wheel bracket 74 protruded from a longitudinal plane of the first "L"-shaped mating surface 71 is housed in the first storage space where located the third "L"-shaped mating surface that formed on the end of the first housing 5. A part body of the second fan wheel bracket 74 is configured to be protruded from a longitudinal plane of the second "L"-shaped mating surface 72, and a portion body of the second fan wheel bracket 74 that protruded from the longitudinal plane of the second "L"-shaped mating surface 72 is housed in the second storage space where located the fourth "L"-shaped mating surface that formed on the end of the second housing 6. By placing the first fan wheel bracket 73 and the second fan wheel bracket 74 through a connection of the mating surface, the fan wheel bracket can form a reinforcing bar support structure in the connection of the mating surface, which can make the connection of the connection of the mating surface more solid, and meanwhile, the "L"-shaped mating surfaces can effectively limit the connecting parts, avoiding relative movement and loosening of the connecting parts during use, which will affect experience of using the product.

Referring to FIG. 3, the flexible connector 7 is formed a shell shape with "U" curvature in a middle portion where protruding from a forward projection direction of the hanging neck fan, the "U" curvature is fitted with a curve of the back of the user's neck, and the shell shape with "U" curvature is configured with an air inlet on a housing surface thereon.

In some embodiments of the present disclosure, a forward reference plane of the hanging neck fan is a side facing the user's head in a state of use. As a preferred embodiment of the present disclosure, an air inlet of the shell shape with "U" curvature is spaced apart bar-shaped skeletonized portions provided through the housing surface. Of course, in some other embodiments of the present disclosure, the air inlet may have other shapes, such as circles, plum blossom shapes, and triangles provided equidistantly or non-equidistantly, and the like, and is not limited to these.

Referring to FIG. 2 to FIG. 6, FIG. 8 and FIG. 9, the first housing 5 is configured with a first air duct 52 along a direction of the free end thereon, and/or the second housing 6 is configured with a second air duct 62 along a direction of the free end thereon. The first housing 5 is configured with a first air outlet along a direction of the first air duct 52, and the second housing 6 is configured with a second air outlet along a direction of the second air duct 62. And the first air outlet and the second air outlet are disposed in a direction toward the user's head.

In some embodiments of the present disclosure, the first housing 5, the second housing 6 are respectively provided with a wind deflector 8, a battery limit section 9, the battery 2, and the main board 1 successively in a direction of the free end thereof. The wind deflector 8 includes at least one first air deflector 81 at an angle to a direction of the free ends of the first housing 5 and the second housing 6, and a second air deflector 82 disposed along a direction of the free ends of the first housing 5 and the second housing 6. The first air deflector 81 is fitted with the second air deflector 82 to form the first air duct 52 and the second air duct 62. As a preferred embodiment of the present disclosure, the first air deflector 81 is provided with several that arranged at equal spacing along the direction of the free ends of the first housing 5 and the second housing 6. The second air deflector 82 is provided with one along the direction of the free ends of the first housing 5 and the second housing 6. The first air deflector 81 and the second air deflector 82 cooperate to form the first air duct 52 and the second air duct 62 that are wide at top and narrow at bottom, so that the air blown by the hanging neck fan can flow effectively throughout the air duct to ensure that the air can continue to be blown from the first air outlet and the second air outlet to the user's head even when it is far away from the hanging neck fan, so as to achieve cooling effect.

As a preferred embodiment of the present disclosure, a plane where located the first fan wheel 3 is paralleled to a plane where located the second fan wheel 4.

In some embodiments of the present disclosure, the first housing 5 and the second housing 6 are symmetrically set in equal length, so that the plane where the first fan wheel 3 is located and the plane where the second fan wheel 4 is located are parallel to each other, so as to ensure that a wind volume blown out from both sides of the hanging neck fan is generally the same, and that a wind speed is balanced, so as to improve the user's comfort.

As another preferred embodiment of the present disclosure, the plane where located the first fan wheel 3 is configured to be intersected with the plane where located the second fan wheel 4 to form a first angle, and the first angle is an angle greater than 0° and less than 360°.

In some embodiments of the present disclosure, the first housing 5 and the second housing 6 are unequal in length, and in a case where the first housing 5 and the second housing 6 are unequal in length, the plane where located the first fan wheel 3 and the plane where located the second fan wheel 4 form a certain angle, which can ensure that an amount of wind blown out from both sides of the hanging neck fan is relatively balanced, thereby improving the user's comfort.

As another preferred embodiment of the present disclosure, the flow direction of the air blown by the first fan wheel 3 is along the axial direction of the first fan wheel 3, and the flow direction of the air blown by the second fan wheel 4 is along the axial direction of the second fan wheel 4.

In some embodiments of the present disclosure, the hanging neck fan is made of an axial flow fan, which making the product less expensive and more efficient in blowing air.

In conclusion, the hanging neck fan of the present disclosure, by providing the first housing and the second housing, and also disposing the first fan wheel and the second fan wheel back-to-back within the first housing and/or the second housing, so that the first fan wheel blows toward the free end of the first housing and the second fan wheel blows toward the free end of the second housing, which can allow the overall weight of the fan wheels to be relatively centralized in the neck position, thus creating better support and improving wearing comfort. In addition, with use of axial fan can make such product less expensive and more efficient in blowing air.

The above detailed description is only an illustration of some preferred embodiments of the present disclosure, and is not intended to limit the scope of the present invention. Any equivalent technical changes made by using contents of the specification and the drawings of the present disclosure are included in the scope of the present invention.

What is claimed is:

1. A hanging neck fan, comprising a main board, a battery, a first fan wheel and a second fan wheel; wherein the battery is electrically connected to the main board, the first fan wheel and the second fan wheel are electrically connected to the main board respectively; and wherein the hanging neck fan further comprises a first housing and a second housing, the first housing and the second housing are configured with the first fan wheel and the second fan wheel inside, respectively;

wherein the first fan wheel and the second fan wheel are disposed back-to-back, the first fan wheel is configured to blow air toward a free end of the first housing and also a flow direction of air blown from the first fan wheel is along an axis of the first fan wheel;

wherein the second fan wheel is configured to blow air toward a free end of the second housing and also a flow direction of air blown from the second fan wheel is along an axis of the second fan wheel, and the first fan wheel and the second fan wheel are fan wheels of axial fans;

wherein the hanging neck fan further comprises a flexible connector, the flexible connector being disposed between the first housing and the second housing and connected to the first housing and the second housing, the first fan wheel and the second fan wheel are configured at both ends of the flexible connector, respectively;

wherein the both ends of the flexible connector are configured with a first "L"-shaped mating surface and a second "L"-shaped mating surface, one end of the first housing that is connected to the flexible connector is configured with a third "L"-shaped mating surface, and one end of the second housing that is connected to the flexible connector is configured with a fourth "L"-shaped mating surface;

wherein the first "L"-shaped mating surface is configured to fit with the third "L"-shaped mating surface for connection, and the second "L"-shaped mating surface is configured to fit with the fourth "L"-shaped mating surface for connection;

wherein the first "L"-shaped mating surface and the second "L"-shaped mating surface are disposed axially symmetrically with respect to a center axis of the flexible connector in a forward projection plane of the hanging neck fan;

wherein both ends of the flexible connector are configured with a first fan wheel bracket and a second fan wheel bracket, respectively, and the first fan wheel bracket and the second fan wheel bracket are embedded with both ends of the flexible connector, respectively; and wherein the first fan wheel is disposed on the first fan wheel bracket, and the second fan wheel is disposed on the second fan wheel bracket.

2. The hanging neck fan according to claim 1, wherein a portion of the body of the first fan wheel bracket is configured to be protruded from a longitudinal plane of the first "L"-shaped mating surface, and a portion of the body of the second fan wheel bracket is configured to be protruded from a longitudinal plane of the second "L"-shaped mating surface; and wherein an end of the first housing where the third "L"-shaped mating surface is located is configured to form a first storage space, and an end of the second housing where the fourth "L"-shaped mating surface is located is configured to form a second storage space;

wherein the portion of the body of the first fan wheel bracket that is protruded from the longitudinal plane of the first "L"-shaped mating surface is configured to be housed in the first storage space when the first "L"-shaped mating surface is fitted with the third "L"-shaped mating surface for connection; and wherein the portion of the body of the second fan wheel bracket that is protruded from the longitudinal plane of the second "L"-shaped mating surface is configured to be housed in the second storage space when the second "L"-shaped mating surface is fitted with the fourth "L"-shaped mating surface for connection.

3. The hanging neck fan according to claim 1, wherein the flexible connector is formed in a shell shape with a "U" curvature in a middle portion where protruding from a forward projection direction of the hanging neck fan, and the shell shape with the "U" curvature is configured with an air inlet on a housing surface thereon.

4. The hanging neck fan according to claim 1, wherein the first housing is configured with a first air duct along a direction of the free end thereon, and the second housing is configured with a second air duct along a direction of the free end thereon; and wherein the first housing is configured with a first air outlet along a direction of the first air duct, and the second housing is configured with a second air outlet along a direction of the second air duct; and wherein the first air outlet and the second outlet are configured to be disposed in a direction toward a user's head.

5. The hanging neck fan according to claim 1, wherein a plane where the first fan wheel is located is paralleled to a plane where the second fan wheel is located.

6. The hanging neck fan according to claim 1, wherein a plane where the first fan wheel is located is configured to be intersected with a plane where the second fan wheel is located to form a first angle, and the first angle is an angle greater than 0° and less than 360°.

* * * * *